US008622390B2

(12) United States Patent
Soga et al.

(10) Patent No.: US 8,622,390 B2
(45) Date of Patent: Jan. 7, 2014

(54) SHEET PROCESSING APPARATUS AND SHEET CONVEYING METHOD

(75) Inventors: Naofumi Soga, Shizuoka-ken (JP); Shoichi Dobashi, Shizuoka-ken (JP); Katsuhiko Tsuchiya, Shizuoka-ken (JP)

(73) Assignees: Kabushiki Kaisha Toshiba, Tokyo (JP); Toshiba Tec Kabushiki Kaisha, Tokyo (KP)

( * ) Notice: Subject to any disclaimer, the term of this patent is extended or adjusted under 35 U.S.C. 154(b) by 0 days.

(21) Appl. No.: 13/427,440

(22) Filed: Mar. 22, 2012

(65) Prior Publication Data

US 2013/0049280 A1 Feb. 28, 2013

Related U.S. Application Data

(60) Provisional application No. 61/529,855, filed on Aug. 31, 2011, provisional application No. 61/528,687, filed on Aug. 29, 2011, provisional application No. 61/545,072, filed on Oct. 7, 2011, provisional application No. 61/532,078, filed on Sep. 7, 2011.

(30) Foreign Application Priority Data

Mar. 8, 2012 (JP) ..... P2012-51398
Mar. 9, 2012 (JP) ..... P2012-52785
Mar. 9, 2012 (JP) ..... P2012-52786

(51) Int. Cl.
*B65H 29/20* (2006.01)

(52) U.S. Cl.
USPC ..... 271/314; 271/176

(58) Field of Classification Search
USPC ..... 271/18.1, 18.2, 34, 94, 95, 10.06, 176, 271/189, 314, 81; 270/59, 58.11
See application file for complete search history.

(56) References Cited

U.S. PATENT DOCUMENTS

| | | | | |
|---|---|---|---|---|
| 7,165,764 | B2 * | 1/2007 | Nakamura et al. | 270/58.11 |
| 7,306,215 | B2 * | 12/2007 | Terao et al. | 270/58.11 |
| 7,354,034 | B2 * | 4/2008 | Nakamura et al. | 270/58.1 |
| 7,406,293 | B2 * | 7/2008 | Terao et al. | 399/405 |
| 7,503,556 | B2 * | 3/2009 | Sugimoto et al. | 270/58.09 |
| 7,997,577 | B2 * | 8/2011 | Oshiro et al. | 271/213 |
| 8,070,155 | B2 * | 12/2011 | Sasahara et al. | 271/176 |

FOREIGN PATENT DOCUMENTS

| | | |
|---|---|---|
| JP | 2008-308251 | 12/2008 |
| JP | 2011-068445 | 4/2011 |
| JP | 2011-102157 | 5/2011 |

* cited by examiner

*Primary Examiner* — Jeremy R Severson
(74) *Attorney, Agent, or Firm* — Patterson & Sheridan, L.L.P.

(57) ABSTRACT

According to one embodiment, a sheet processing apparatus includes: a paper feeding section configured to receive a sheet and feed the sheet; a detecting section configured to detect the fed sheet; a standby tray on which the fed sheet is stacked, the standby tray including a first roller configured to convey the sheet; a second roller configured to pivot to come into contact with and separate from the first roller; a processing tray on which the sheet dropped and supplied from the standby tray is stacked, the processing tray holding the sheet while requested processing is applied to the sheet; a paper discharge section configured to receive the sheet subjected to the processing and discharged from the processing tray; and a control section configured to separate the second roller from the first roller according to a result of the detection during conveyance of the sheet to the standby tray.

18 Claims, 16 Drawing Sheets

SHEET PROCESSING APPARATUS AND SHEET CONVEYING METHOD

CROSS-REFERENCE TO RELATED APPLICATIONS

This application is based upon and claims the benefit of priority from the prior U.S. Patent Applications No. 61/528,687, filed on Aug. 29, 2011, No. 61/529,855, filed on Aug. 31, 2011, No. 61/532,078, filed on Sep. 7, 2011, and No. 61/545,072, filed on Oct. 7, 2011, the entire contents all of which are incorporated herein by reference.

This application is also based upon and claims the benefit of priority from the prior Japanese Patent Applications No. 2012-51398, filed on Mar. 8, 2012, and No. 2012-52785, filed on Mar. 9, 2012, and No. 2012-52786, filed on Mar. 9, 2012, the entire contents all of which are incorporated herein by reference.

FIELD

Embodiments described herein relate generally to a sheet processing apparatus and a sheet conveying method.

BACKGROUND

In a sheet processing apparatus in the past, when a long-size sheet longer than, for example, the normal A4 size in a paper discharge direction is discharged to a discharge tray, the leading end of the sheet tends to hang down. Consequently, when the leading end of the long-size sheet comes into contact with a sheet stacking surface of the discharge tray, the sheet curls and causes a stacking failure.

DETAILED DESCRIPTION

Figure 1:
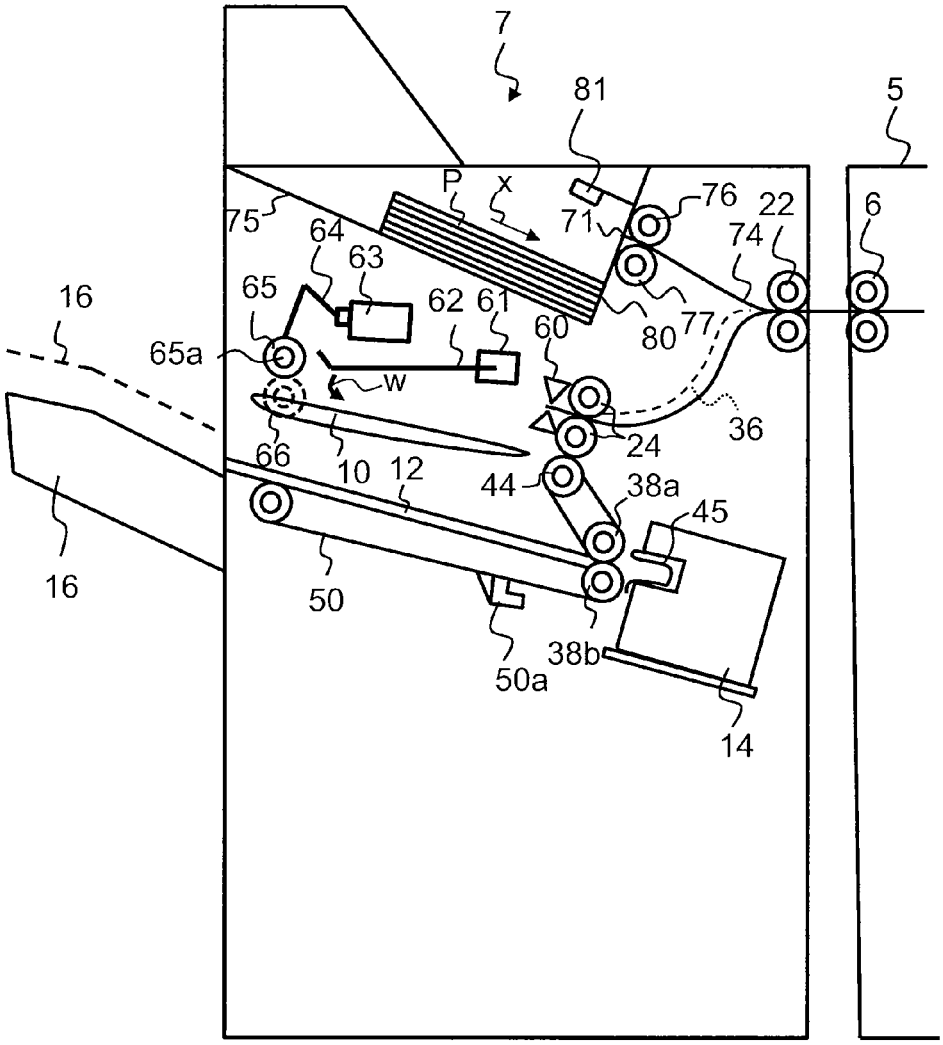
FIG. 1 is a configuration diagram of a sheet processing apparatus in a first embodiment.

In general, according to one embodiment, it is to provide a sheet processing apparatus including: a paper feeding section configured to receive a sheet conveyed from an apparatus at a preceding stage and feed the sheet; a detecting section configured to detect the sheet fed by the paper feeding section; a standby tray on which the sheet fed by the paper feeding section is stacked, the standby tray including a first roller configured to convey the sheet; a second roller located above the standby tray and configured to pivot to come into contact with and separate from the first roller; a processing tray on which the sheet dropped and supplied from the standby tray is stacked, the processing tray holding the sheet while requested processing is applied to the sheet; a paper discharge section configured to receive the sheet subjected to the processing and discharged from the processing tray; and a control section configured to separate the second roller from the first roller at predetermined timing according to a result of the detection by the detecting section during the conveyance of the sheet to the standby tray.

Embodiments will now be described in more detail with reference to the accompanying drawings. However, the same numerals are applied to the similar elements in the drawings, and therefore, the detailed descriptions thereof are not repeated.

First Embodiment

In a sheet processing apparatus according to a first embodiment, for a fixed time, a pivoting roller (a second roller) of a standby tray is separated from a standby tray roller (a first roller) during the conveyance of a sheet P to the standby tray.

FIG. 1 is a configuration diagram of the sheet processing apparatus. Processing of sheets by the sheet processing apparatus is usually called sheet finishing and includes stapling, sorting, hole punching, and saddle binding. In this embodiment, a sheet processing apparatus that applies the stapling is explained.

As shown in FIG. 1, a fixed tray 75 is provided in an upper surface section of a sheet processing apparatus 7. The fixed tray 75 is tilted such that the leading end of sheets P stacked thereon is higher than the trailing end of the sheets P. A pair of sheet discharge rollers 76 and 77 that include a discharging mechanism and nip and convey the sheet P are provided adjacent to a paper discharge port 71 of the fixed tray 75. A fixed tray path 74 that leads the sheet P to the sheet discharge rollers 76 and 77 is provided between an inlet roller 22, which receives the sheet P from an apparatus at a preceding stage such as an image forming apparatus 5, and the paper discharge port 71.

Plural tray ribs 80 functioning as trailing end supporting members that support the trailing end of the sheets P are provided below the paper discharge port 71. The fixed tray 75 and the tray ribs 80 are integrally molded. A sensor 81 that detects a stacking limit of the sheets P stacked on the fixed tray 75 is attached above the paper discharge port 71.

The fixed tray 75 is arranged to tilt such that the leading end side of the sheets P is higher than the trailing end side of the sheets P as explained above. Therefore, the sheet P conveyed to the fixed tray 75 returns in an arrow x direction, which is a sheet trailing end direction, making use of the tilt of the fixed tray 75 and comes into contact with the tray ribs 80 at the trailing end to be vertically aligned. The sheets P discharged from the image forming apparatus 5 in the same manner are sequentially discharged onto the fixed tray 75 until the number of sheets P reaches a predetermined number and are vertically aligned.

A standby tray 10 is provided below the fixed tray 75. A paper path 36 that leads the sheet P to a pair of paper feeding rollers (a paper feeding section) 24 is provided between the inlet roller 22 and the standby tray 10. An outlet sensor (a detecting section) 60 is provided between the paper feeding rollers 24 and the standby tray 10. In this embodiment, the outlet sensor 60 is arranged adjacent to the paper feeding rollers 24. The outlet sensor 60 detects the sheet P conveyed via the paper path 36. It is assumed that, when the outlet sensor 60 detects the sheet P, the paper feeding rollers 24 nip and convey the sheet P.

Figure 2:
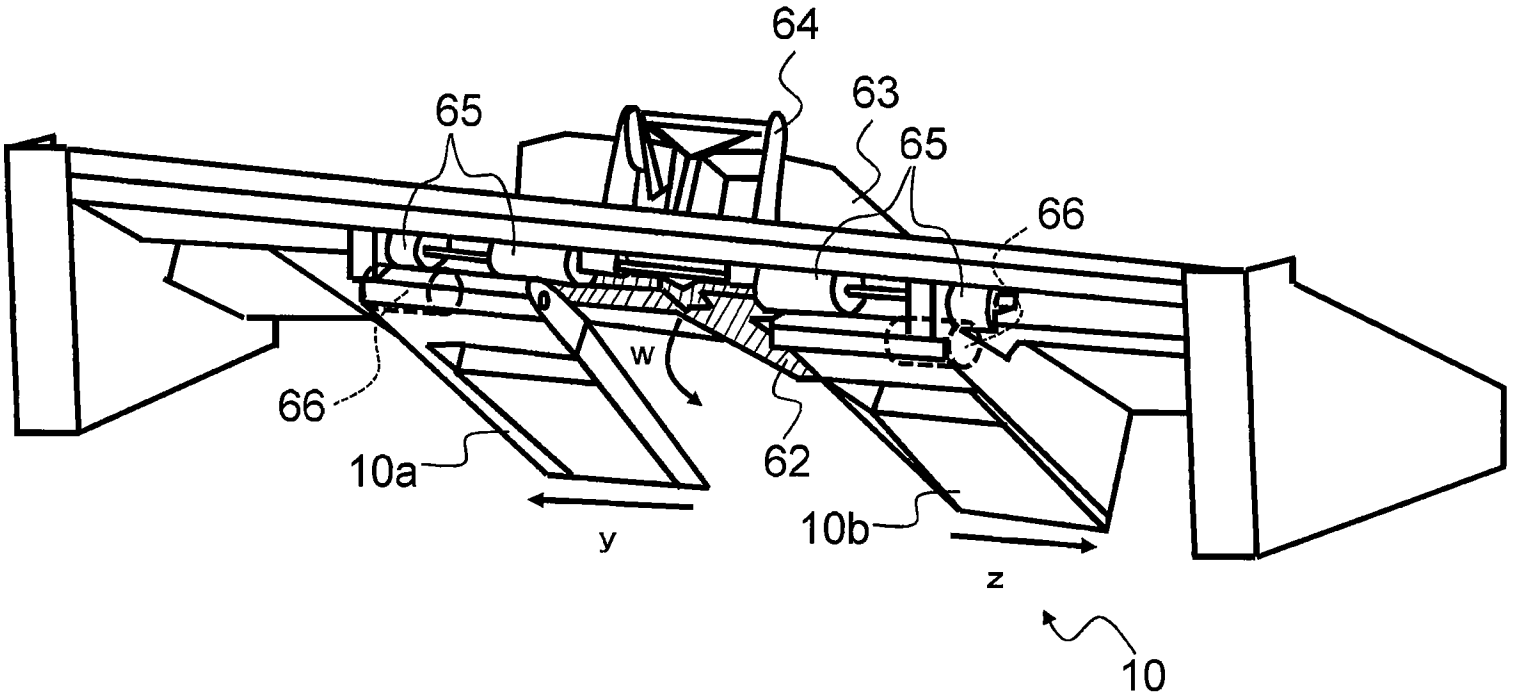
FIG. 2 is a perspective view of a standby tray in the first embodiment.

The standby tray 10 explained in detail later with reference to FIG. 2 has grooves for providing standby tray rollers 66. The standby tray rollers 66 are fit in the grooves of the standby tray 10. A part of the standby tray rollers 66 project upward from the standby tray 10. A rotating shaft of the standby tray rollers 66 is incorporated in the standby tray 10. The standby tray rollers 66 are respectively incorporated in tray members 10*a* and 10*b*. Pivoting rollers 65 are located above the standby tray 10. The plural pivoting rollers 65 are configured integrally with a pivoting roller shaft 65*a* in a direction orthogonal to a conveying direction of the sheet P as shown in FIG. 2. This is not a limitation. One pivoting roller 65 long in the direction orthogonal to the conveying direction may be configured integrally with the pivoting roller shaft 65*a*. In this way, the pivoting rollers 65 are provided in plural places or the long one pivoting roller 65 is provided integrally with the pivoting roller shaft 65*a* in the direction orthogonal to the conveying direction. Consequently, even if the standby tray rollers 66 slide according to a sheet size, the standby tray rollers 66 and the pivoting rollers 65 come into contact with each other. The standby tray rollers 66 partially projecting from the standby tray 10 and the pivoting rollers 65 nip the sheet P and convey the sheet P to the standby tray 10.

A processing tray 12 on which the sheets P dropped and supplied from the standby tray 10, i.e., from between the moving tray members 10*a* and 10*b* is arranged below the standby tray 10. Roller pairs formed by the pivoting rollers 65 and the standby tray rollers 66 are located on the downstream side of the paper feeding rollers 24 and convey the sheet P conveyed by the paper feeding rollers 24.

The processing tray 12 aligns and supports the sheets P stacked thereon while the sheets P are stapled by a stapler 14. The processing tray 12 is arranged to tilt down toward the stapler 14. The processing tray 12 includes a pair of upper and lower aligning rollers 38*a* and 38*b* that align the plural sheets P, which are dropped and supplied from the standby tray 10, in a longitudinal direction, which is the conveying direction. The aligning rollers 38*a* and 38*b* are provided near the stapler 14. The aligning rollers 38*a* and 38*b* are also used as bundle conveying rollers that nip a sheet bundle T subjected to stapling and remove the sheet bundle T from the stapler 14.

A paddle 44 mounted on the processing tray 12 is arranged in a position where the trailing end of the sheets P drops when the sheets P are dropped and supplied from the standby tray 10 to the processing tray 12. The paddle 44 is rotatable and aligns the top sheet P in the longitudinal direction. The paddle 44 is made of, for example, a rubber material and has elasticity.

A stopper 45 that comes into contact with the trailing end of the sheets P and regulates the trailing end position is provided at an end on the stapler 14 side of the processing tray 12. A conveyor belt 50 is provided substantially in the center of the processing tray 12. The conveyor belt 50 conveys the sheet bundle T subjected to the stapling and removed from the stapler 14 by the upper and lower aligning rollers 38*a* and 38*b* to a first paper discharge tray (a paper discharge section) 16. A feeding claw 50*a* that catches the trailing end of the sheet bundle T is attached to the conveyor belt 50.

Figure 3:
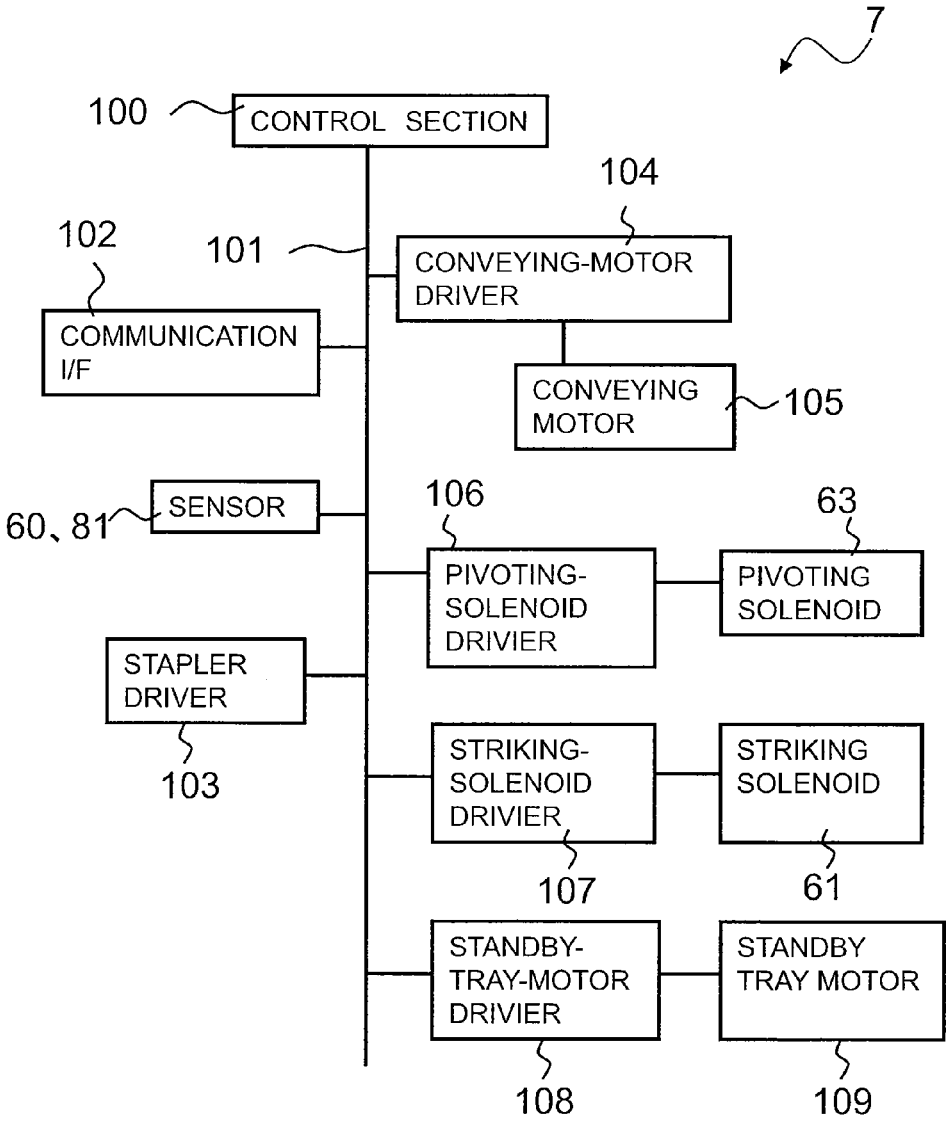
FIG. 3 is a block diagram of the sheet processing apparatus in the first embodiment.

The standby tray 10 can drop and supply the sheets P to the processing tray 12. On the other hand, the standby tray 10 can convey the sheets P not subjected to stapling in the direction of the first paper discharge tray 16. The roller pairs of the pivoting rollers 65 and the standby tray rollers 66 convey the sheets P to the first paper discharge tray 16 while coming into contact with the sheets P on the standby tray 10. The pivoting rollers 65 are driven to rotate by a pivoting solenoid 63 via an arm 64 and are driven to rotate by a conveying motor 105 (FIG. 3). The conveying motor 105 is connected to the pivoting roller shaft 65*a* that rotatably supports the pivoting rollers 65. The pivoting rollers 65 are driving rollers and the standby tray rollers 66 are driven rollers. The standby tray rollers 66 rotate according to the rotation of the pivoting rollers 65 when the standby tray rollers 66 are in contact with the pivoting rollers 65. When the standby tray rollers 66 and the pivoting rollers 65 are in contact with each other, nips are formed between the standby tray rollers 66 and the pivoting rollers 65.

A striking member 62 is provided above the standby tray 10. The striking member 62 is controlled by a striking solenoid 61. The striking member 62 strikes the sheets P, which are conveyed to the standby tray 10, in an arrow w direction to thereby form corrugation curving along the conveying direction (hereinafter simply referred to as corrugation) in the center of the sheets P. The striking member 62 also strikes the sheets P when the sheets P are dropped from the standby tray 10 to the processing tray 12. When the striking member 62 strikes the sheets P, if the sheets P are thin, a striking mark is likely to remain on the sheets P. Therefore, protective members may be attached to the corners and the bottom surface of the striking member 62. The protective members are, for example, sheets or sponges. The striking member 62 may be rounded off at the corners and formed in a roundish shape.

FIG. 2 is a perspective view of the standby tray 10. The standby tray 10 is arranged to tilt such that the leading end of the sheets P is higher than the trailing end of the sheets P. The standby tray 10 includes the pair of tray members 10*a* and 10*b*. The tray members 10*a* and 10*b* receive the sheets P and support both the sides of the sheets P in a state in which the tray members 10*a* and 10*b* are slid to the width of the sheet P. Standby stoppers that regulate the trailing end of the sheets P are provided in the tray members 10*a* and 10*b*. The standby tray 10 is slid by a standby tray motor 109 (FIG. 3). The tray member 10*a* slides in an arrow y direction and a direction opposite to the arrow y direction. The tray member 10*b* slides in an arrow z direction and a direction opposite to the arrow z direction. The standby tray rollers 66 are provided in the standby tray 10. The standby tray rollers 66 also move according to the sliding of the standby tray 10.

A series of flow of the sheet P in the sheet processing apparatus 7 is explained. There are three paths for conveying the sheet P. A first conveying path is a path through which the sheet P is discharged to the fixed tray 75 without being subjected to stapling. A second conveying path is a path through which the sheet P is discharged to the paper discharge tray 16 without being subjected to stapling. A third conveying path is a path through which the sheet P is subjected to stapling and discharged from the processing tray 12 to the paper discharge tray 16.

The first conveying path is explained. If the sheet P is discharged to the fixed tray 75 without being subjected to stapling, the sheet P discharged from a paper feeding roller 6 of the image forming apparatus 5 is conveyed to the sheet discharge rollers 76 and 77 by the inlet roller 22 via the tray path 74 and discharged to the fixed tray 75. The sheets P discharged from the image forming apparatus 5 are sequentially discharged to the fixed tray 75 and vertically aligned until the number of sheets P reaches a predetermined number.

The second conveying path is explained. If the sheet P is discharged to the first paper discharge tray 16 without being subjected to stapling, for example, the paper discharge tray 16 slides to a position indicated by a dotted line in FIG. 1 in advance. If stapling is not performed, the sheet P conveyed to the inlet roller 22 is conveyed to the paper feeding rollers 24 from the inlet roller 22 via the paper path 36 and fed to the standby tray 10 by the paper feeding rollers 24. Subsequently, the sheet P is conveyed on the standby tray 10 by the pivoting rollers 65 and the standby tray rollers 66 and discharged to the paper discharge tray 16.

The third conveying path is explained. When stapling is performed, the tray members 10*a* and 10*b* slide and the standby tray 10 can support the sheets P. The sheet P discharged from the image forming apparatus 5 and supplied by the paper feeding rollers 24 is placed on the standby tray 10 in order to, for example, wait for stapling of the preceding sheets P to be completed on the processing tray 12. The plural sheets P are stacked on the standby tray 10 until completion of the processing on the processing tray 12.

When the preceding sheets P on the processing tray 12 are discharged onto the paper discharge tray 16 and the stapling on the processing tray 12 is completed, the tray members 10*a* and 10*b* shown in FIG. 2 respectively slide in the arrow y direction and the arrow z direction. When the tray members 10*a* and 10*b* slide, the striking member 62 strikes the sheets P from above in the arrow w direction. The sheets P placed on the standby tray 10 are dropped to the processing tray 12 according to the sliding of the tray members 10*a* and 10*b* and the sheet striking by the striking member 62. After the stapling, a control section 100 shown in FIG. 5 drives the conveyor belt 50 to hook the trailing end of the sheet bundle T subjected to the stapling to the feeding claw 50*a*, and convey the sheet bundle T to the paper discharge tray 16.

When the long-size sheet P is conveyed to the standby tray 10, even if the pivoting rollers 65 are separated from the standby tray rollers 66, it is possible to convey the sheet P to the standby tray 10 according to the conveyance by the paper feeding rollers 24. When the pivoting rollers 65 functioning as the driving rollers separate from the standby tray rollers 66 functioning as the driven rollers, the standby tray rollers 66 do not have conveying force for the sheet P. However, since the long-size sheet P such as an FOLIO sheet has sufficient length, the sheet P can be conveyed to the standby tray 10 by the paper feeding rollers 24 located upstream the standby tray rollers 66.

At this point, since the long-size sheet P such as the FOLIO sheet is long in the longitudinal direction, even if the pivoting rollers 65 are separated from the standby tray rollers 66 or the processing for forming corrugation by sheet striking of the striking member 62 is applied to the sheet, although hanging-down of the sheet P is suppressed, the sheet P comes into contact with the paper discharge tray 16. Even in the conveyance of the sheet P through the third conveying path, when the sheet P is put on standby on the standby tray 10, the leading end of the sheet P comes into contact with the paper discharge tray 16.

FIG. 3 is a block diagram of the sheet processing apparatus 7. The control section 100 of the sheet processing apparatus 7 includes, for example, a CPU (Central Processing Unit), a ROM (Read Only Memory), and a RAM (Random Access Memory). The ROM has stored therein a computer program for causing the CPU to operate. The RAM stores, for example, data of the number of sheets P to be processed and various kinds of information transmitted from the image forming apparatus 5 at a preceding stage of the sheet processing apparatus 7. The control section 100 communicates with the image forming apparatus 5, a client PC (not shown), and an external server (not shown) through a communication interface (I/F) 102 connected via a system bus 101.

The control section 100 is connected to, via the system bus 101, the communication I/F 102, sensors 60 and 81, and a STAPLER DRIVER 103 that controls the stapler 14. The control section 100 is connected to, via the system bus 101, a CONVEYING-MOTOR DRIVER 104 that controls the conveying motor 105, a PIVOTING-SOLENOID DRIVER 106 that controls the pivoting solenoid 63, a STRIKING-SOLENOID DRIVER 107 that controls the striking solenoid 61, and a STANDBY-TRAY-MOTOR DRIVER 108 that controls the standby tray motor 109. The control section 100 controls, via the system bus 101, the driving of the conveying motor 105, ON and OFF of the pivoting solenoid 63 and the striking solenoid 61, and the driving of the standby tray motor 109.

The conveying motor 105 is connected to the inlet roller 22, the paper feeding rollers 24, the aligning rollers 38*a* and 38*b*, and the pivoting rollers 65. The conveying motor 105 is not limited to one conveying motor and may be plural motors connected to the respective rollers.

The pivoting solenoid 63 pivots, via the arm 64, the pivoting rollers 65 with a second shaft 71 (see FIG. 5) set as a center axis. When the pivoting rollers 65 are pivoted in an arrow t direction (see FIG. 5) from a state of contact with the standby tray rollers 66, the pivoting rollers 65 separate from the standby tray rollers 66. When the pivoting rollers 65 are pivoted in a direction opposite to the arrow t direction from a state of separation from the standby tray rollers 66, the pivoting rollers 65 come into contact with the standby tray rollers 66.

The striking solenoid 61 pivots the striking member 62. When the control section 100 turns on the striking solenoid 61, the striking member 62 pivots in the arrow w direction as shown in FIGS. 1 and 2. The striking member 62 strikes the sheets P according to the pivoting in the arrow w direction. When the striking solenoid 61 is turned off, the striking member 62 pivots in a direction opposite to the arrow w direction and returns to an original position. The original position is a position before the striking member 62 pivots in the arrow w direction. The control section 100 controls the striking member 62 to retract into a sheet conveying path (see FIG. 1), which is a home position of the striking member 62, not to prevent sheet conveyance other than time when the striking member 62 strikes the sheets P to form corrugation on the sheets P.

The standby tray motor 109 slides the tray members 10*a* and 10*b*. The standby tray motor 109 can rotate in a forward direction and rotate in a direction opposite to the forward direction. For example, when the standby tray motor 109 is rotated in the forward direction, the tray member 10*a* slides in the arrow y direction and the tray member 10*b* slides in the arrow z direction. When the standby tray motor 109 is rotated in the direction opposite to the forward direction, the tray member 10*a* slides in the direction opposite to the arrow y direction and the tray member 10*b* slides in the direction opposite to the arrow z direction.

Figure 4:
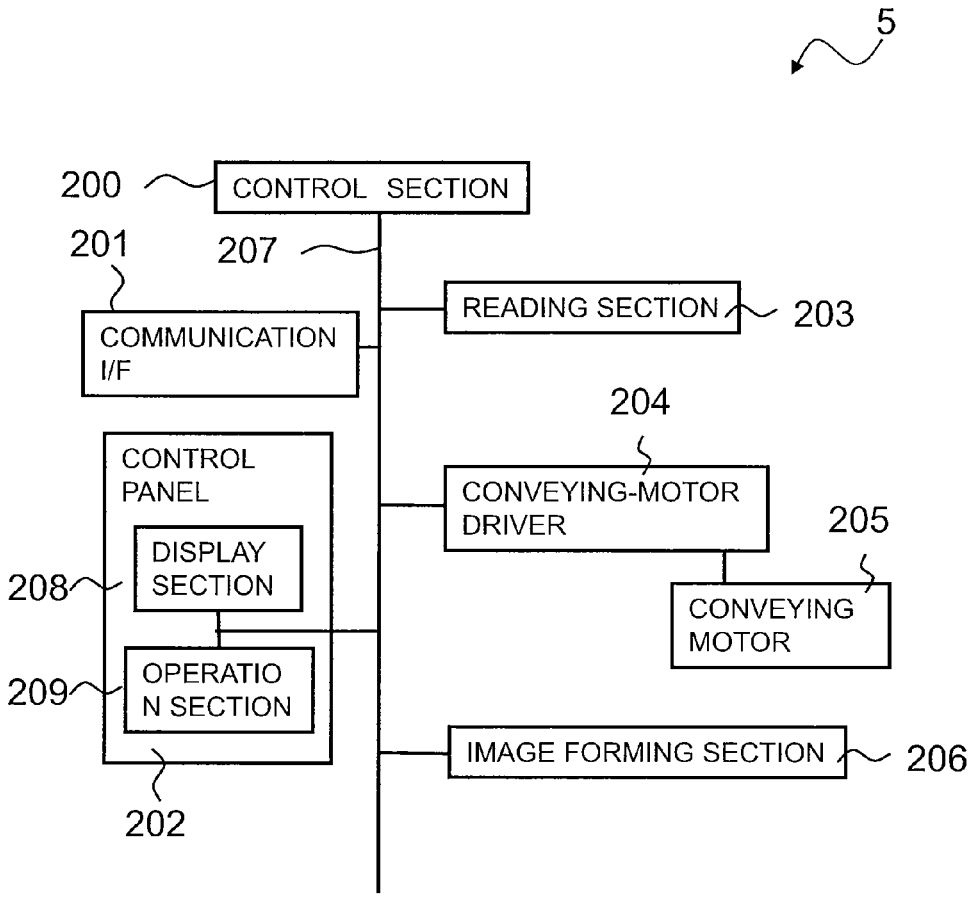
FIG. 4 is a block diagram of an image forming apparatus in the first embodiment.

FIG. 4 is a block diagram of the image forming apparatus 5 located at the preceding stage of the sheet processing apparatus 7 according to this embodiment. The image forming apparatus 5 is a well-known apparatus and includes, for example, a control section 200 including a CPU, a ROM, and a RAM, a communication I/F 201, a control panel 202, a reading section 203, a CONVEYING-MOTOR DRIVER 204 that drives a conveying motor 205 connected to conveying rollers, and an image forming section 206. These sections are connected by a system bus 207. The control panel 202 includes a display section 208 and an operation section 209. The display section 208 may be a touch panel type and may also function as an operation section. The operation section 209 includes various keys. A user can select a type of the sheet P, a printing mode, and a sheet size using the control panel 202. Types of the sheets P are, for example, plain paper, recycled paper, thin paper, and thick paper. Printing modes are, for example, a color mode and a monochrome mode. Sheet sizes are, for example, A3, A4, and A5 sizes, a LETTER size, and an FOLIO size. The control section 200 of the image forming apparatus 5 transmits various kinds of information such as a type of the sheets P, a printing mode, and a sheet size selected by the user from the communication I/F 201 to the control section 100 via the communication I/F 102 of the sheet processing apparatus 7.

Figure 5:
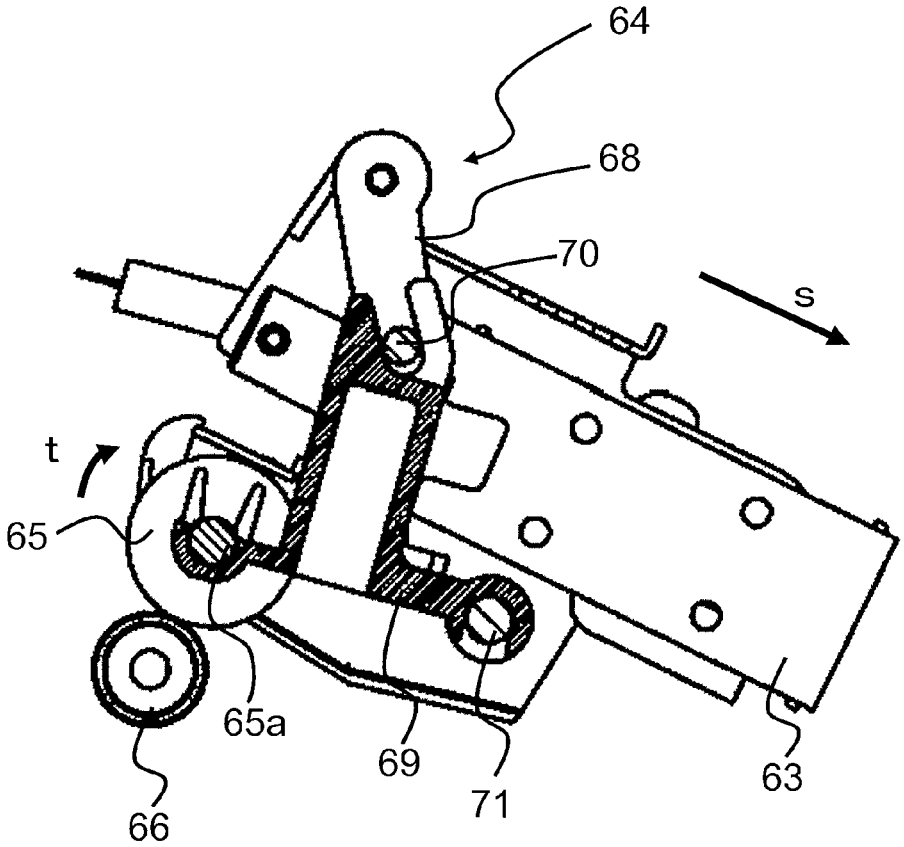
FIG. 5 is a diagram of a contact state of pivoting rollers and standby tray rollers in the first embodiment.
Figure 6:
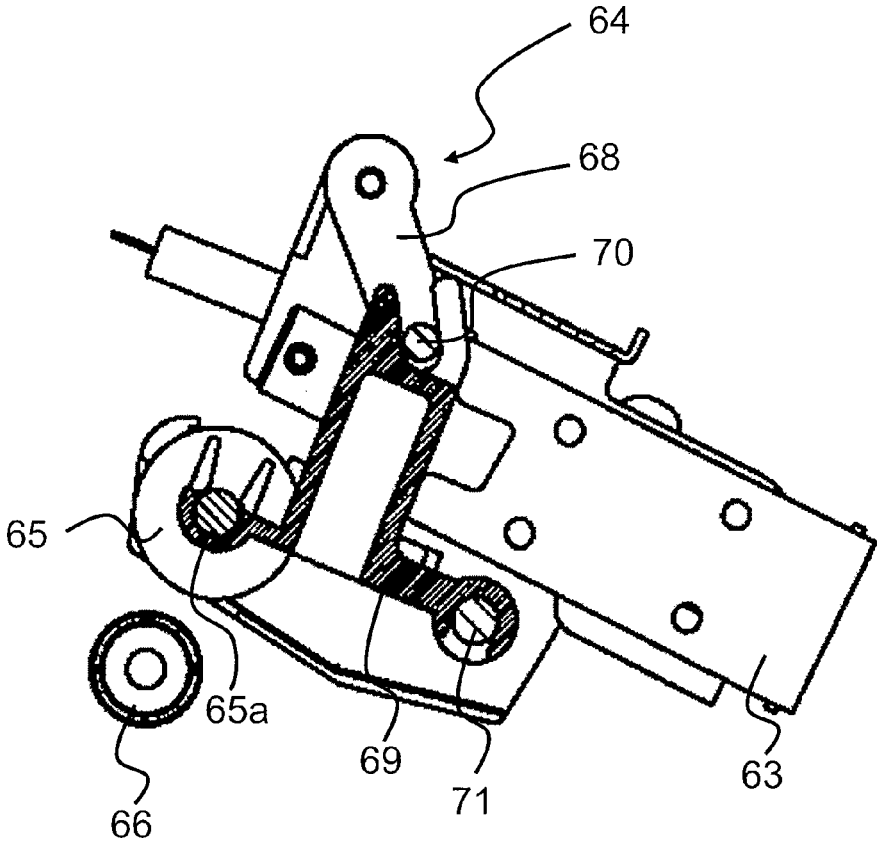
FIG. 6 is a diagram of a separated state of the pivoting rollers and the standby tray rollers in the first embodiment.

FIG. 5 is a diagram of a contact state of the pivoting rollers 65 and the standby tray rollers 66 in the sheet processing apparatus 7. FIG. 6 is a diagram of a separated state of the pivoting rollers 65 and the standby tray rollers 66. The contact state of the pivoting rollers 65 and the standby tray rollers 66 shown in FIG. 5 is a home position. The arm 64 includes a first arm 68, a second arm 69, a first shaft 70, the second shaft 71, and the pivoting roller shaft 65*a*. The first arm 68 is connected to the pivoting solenoid 63. The second arm 69 is pivotably connected to the first arm 68 via the first shaft 70. The second shaft 71 is fixed. The second arm 69 pivots about the fixed second shaft 71. The pivoting roller shaft 65*a* is connected to the second arm 69.

When the pivoting solenoid 63 is turned on, the pivoting solenoid 63 moves in an arrow s direction together with the first arm 68. The second arm 69 pivots in the arrow t direction about the fixed second shaft 71. At this point, the pivoting roller shaft 65*a* connected to the second arm 69 pivots in the arrows direction together with the second arm 69. Therefore, when the pivoting solenoid 63 is turned on, the pivoting rollers 65 separate from the standby tray rollers 66 (see FIG. 6).

When the pivoting solenoid 63 is turned off, the pivoting solenoid 63 moves in a direction opposite to the arrow s direction together with the first arm 68 connected to the pivoting solenoid 63. The second arm 69 pivots in the direction opposite to the arrow t direction about the fixed second shaft 71. At this point, the pivoting roller shaft 65*a* connected to the second arm 69 also pivots in the direction opposite to the arrow s direction together with the second arm 69. Therefore, when the pivoting solenoid 63 is turned off, the pivoting rollers 65 come into contact with the standby tray rollers 66 and return to the state shown in FIG. 5.

Figure 7:
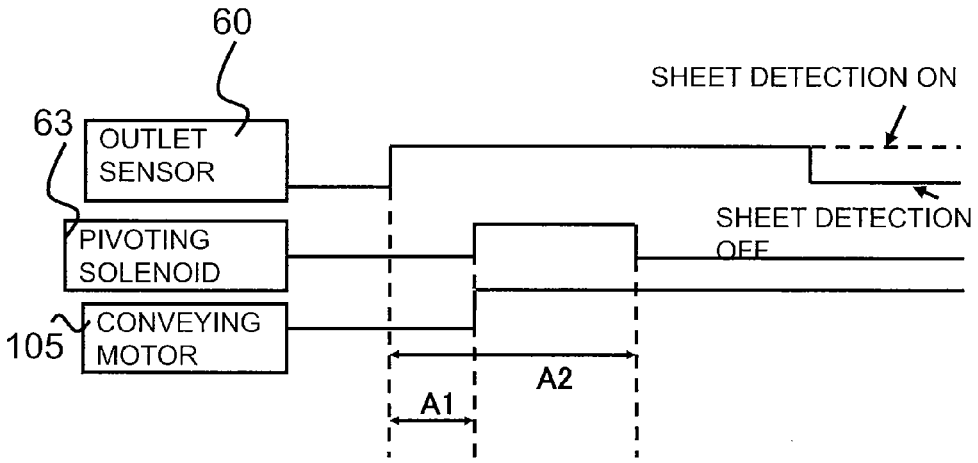
FIG. 7 is a timing chart of pivoting of the pivoting rollers in the first embodiment.

FIG. 7 is a timing chart of pivoting of the pivoting rollers 65. The control section 100 turns on the pivoting solenoid 63 and drives the conveying motor 105 when the number of steps A1 elapses after the outlet sensor 60 detects the sheet P. The control section 100 turns off the pivoting solenoid 63 when the number of steps A2 elapses after the outlet sensor 60 detects the sheet P.

According to the control of the sections at the timings explained above, the pivoting rollers 65 are separated from the standby tray rollers 66 for a fixed time during the conveyance of the sheet P in the standby tray 10. After the pivoting rollers 65 are separated from the standby tray rollers 66 for a fixed time, the pivoting rollers 65 and the standby tray rollers 66 are brought into contact with each other again.

Timing for changing the pivoting solenoid 63 from ON to OFF may be timing when it is confirmed that the leading end of the sheet P comes into contact with the paper discharge tray 16 or a predetermined number of steps elapses after the sheet detection in the outlet sensor 60 is turned off. The predetermined number of steps is, when a stepping motor is used, the number of steps at which the leading end of the sheet P is assumed to come into contact with a sheet stacking surface of the paper discharge tray 16 after the outlet sensor 60 detects the sheet P. The predetermined number of steps may be the number of steps at which the conveyance of the sheet P to the standby tray 10 is assumed to end. The timing for changing the pivoting solenoid 63 from ON to OFF may be timing when the sheet detection in the outlet sensor 60 is turned off. By controlling the pivoting solenoid 63 in this way, it is possible to convey the sheet P with corrugation sufficiently formed on the sheet P.

As shown in FIG. 2, there is a space between the tray members 10*a* and 10*b*. Therefore, when the sheet P collides against the tray members 10*a* and 10*b*, corrugation is formed on the sheet P fed by the paper feeding rollers 24. In other words, the leading end of the sheet P forms a recess on the sheet P in the space between the tray members 10*a* and 10*b*. However, when the sheet P is further fed and is conveyed in the contact state of the pivoting rollers 65 and the standby tray rollers 66, in a portion of the sheet P passed through the nips between the pivoting rollers 65 and the standby tray rollers 66, the corrugation formed during the collision against the tray members 10*a* and 10*b* disappears. When the sheet P passes the nips between the pivoting rollers 65 and the standby tray rollers 66, the sheet P is flattened by the conveying force of the pivoting rollers 65 and the standby tray rollers 66. When the conveyance of the sheet P is continued in a state in which the pivoting rollers 65 are set in contact with the standby tray rollers 66, the sheet P flattens and hangs down with the gravity. Therefore, when the sheet P comes into contact with the sheet stacking surface of the paper discharge tray 16, it is likely that a stacking failure of the sheet P is caused.

However, as explained above, the pivoting rollers 65 are separated from the standby tray rollers 66 for the fixed time during the conveyance of the sheet P in the standby tray 10. This makes it possible to convey the sheet P in a state in which the corrugation of the sheet P formed during the collision against the tray members 10*a* and 10*b* is maintained. When the sheet P passes the nips between the pivoting rollers 65 and the standby tray rollers 66, the leading end of the sheet P flattens. However, the trailing end of the sheet P maintains the corrugation of the sheet P formed during the collision against the tray members 10*a* and 10*b*. When the pivoting rollers 65 are separated from the standby tray rollers 66 for the fixed time in this state, the leading end of the sheet P regains the corrugation with the own weight of the sheet P.

The separation of the pivoting rollers 65 from the standby tray rollers 66 is performed at an early stage after the outlet sensor 60 detects the leading end of the sheet P and the leading end of the sheet P passes the roller pairs of the pivoting rollers 65 and the standby tray rollers 66. For example, the pivoting rollers 65 are separated from the standby tray rollers 66 when the leading end of the sheet P moves forward about several tens millimeters after passing the roller pairs of the pivoting rollers 65 and the standby tray rollers 66. When the sheet P is conveyed, for example, several tens millimeters after the separation of the pivoting rollers 65 from the standby tray rollers 66, the roller pairs of the pivoting rollers 65 and the standby tray rollers 66 nip and convey the sheet P again. When the pivoting rollers 65 are separated from the standby tray rollers 66, the conveyance is performed by the paper feeding rollers 24.

The control section 100 may control the pivoting solenoid 63 to be turned on after the outlet sensor 60 detects the sheet P and before the sheet P passes the roller pairs of the pivoting rollers 65 and the standby tray rollers 66. In this case, the control section 100 separates the pivoting rollers 65 from the standby tray rollers 66 before the sheet P passes the roller pairs of the pivoting rollers 65 and the standby tray rollers 66. The control section 100 controls the roller pairs of the pivoting rollers 65 and the standby tray rollers 66 to nip and convey the sheet P after the leading end of the sheet P moves forward on the standby tray rollers 66 several tens millimeters.

When the pivoting rollers 65 are brought into contact with the standby tray rollers 66 again after being separated from the standby tray rollers 66 for the fixed time and the sheet P is conveyed in this way, the corrugation is maintained and the sheet P does not hang down.

The sheet P tends to hang down when the sheet P is the long size. Therefore, if the control section 100 determines that the long-size sheet P is processed, the pivoting rollers 65 may be separated from the standby tray rollers 66 as explained above. The long-size sheet P is the sheet P equal to or larger than, for example, the A3 or FOLIO size. The control section 100 receives various kinds of information such as a type of the sheet P, a printing mode, and a sheet size transmitted from the image forming apparatus 5. If the control section 100 determines that the sheet size is size or length equal to or larger than a specified value, the control section 100 controls the pivoting rollers 65 to separate from the standby tray rollers 66.

Figure 8:
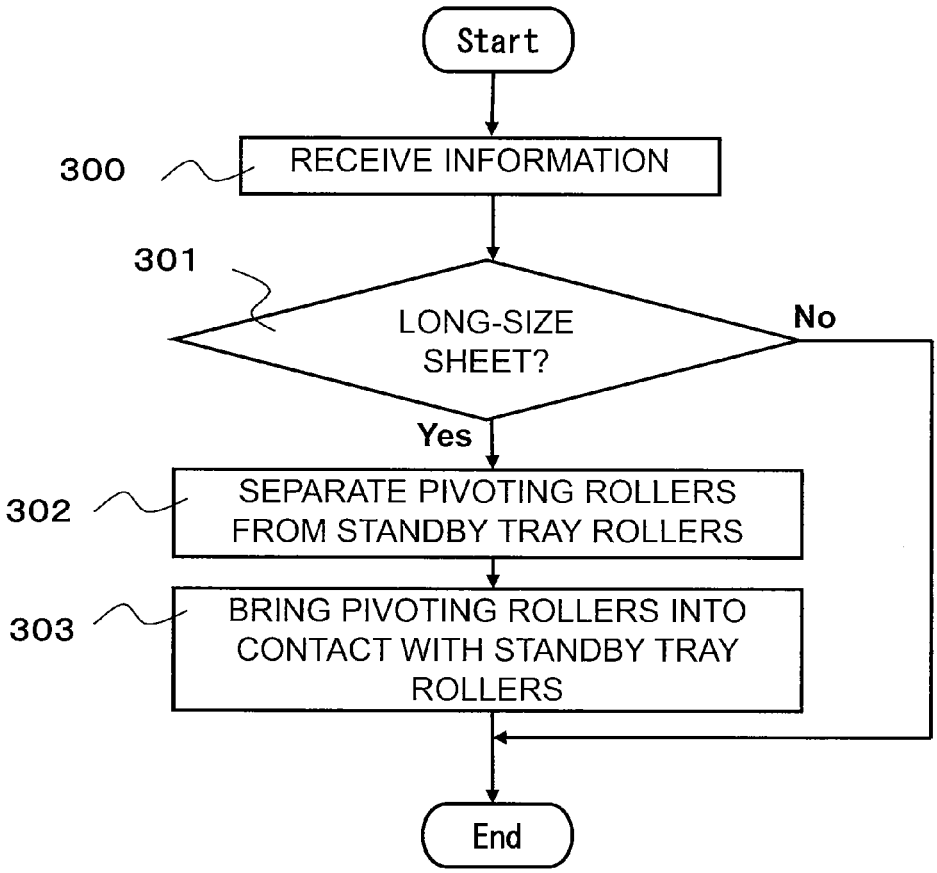
FIG. 8 is a flowchart for determining whether the pivoting rollers are separated from the standby tray rollers in the first embodiment.

FIG. 8 is a flowchart for determining whether the pivoting rollers 65 are separated from the standby tray rollers 66. In 300, the control section 100 receives various kinds of information transmitted from the control section 200 of the image forming apparatus 5. The various kinds of information include a type of the sheet P, a printing mode, and a sheet size selected by the user. In 301, the control section 100 determines from the received various kinds of information whether the sheet P is the long-size sheet P. If the control section 100 determines that the sheet P is not the long-size sheet P (NO in 301), the control section 100 conveys the sheet P in a state in which the pivoting rollers 65 are set in contact with the standby tray rollers 66 without separating the pivoting rollers 65 from the standby tray rollers 66 and ends conveyance processing of the sheet P to the standby tray 10.

If the control section 100 determines that the sheet P is the long-size sheet P (Yes in 301), in 302, as shown in FIG. 7, the control section 100 separates the pivoting rollers 65 from the standby tray rollers 66 when the numbers of steps A1, which is predetermined timing, elapses after the outlet sensor 60 detects the sheet P. Thereafter, in 303, the control section 100 brings the standby tray rollers 66 into contact with the pivoting rollers 65 and ends the conveyance processing of the sheet P to the standby tray 10 when the number of steps A2, which is predetermined timing, elapses after the outlet sensor 60 detects the sheet P.

In the above explanation, the sheet processing apparatus that performs stapling as finishing of sheets is explained. However, the sheet processing apparatus may be a sheet processing apparatus that performs sorting, hole punching, or saddle binding. The control section 100 performs control for applying processing according to the number of steps. However, this is not a limitation and the control section 100 may perform control to apply processing according to an elapsed time.

The separation of the pivoting rollers 65 from the standby tray rollers 66 is performed in the third conveying path for dropping the sheets P from the standby tray 10 to the processing tray 12, applying finishing to the sheets P, and discharging the sheets P to the paper discharge tray 16. In the third conveying path, the separation of the pivoting rollers 65 from the standby tray rollers 66 is performed for the first sheet P put on standby on the standby tray 10. If corrugation is formed on the first sheet P put on standby on the standby tray 10, thereafter, corrugation is also formed on the second and subsequent sheets P stacked on the first sheet P. Since the second and subsequent sheets P are placed on the first sheet P, the second and subsequent sheets P are stacked on the standby tray 10 in the same shape as the first sheet P.

This is not a limitation. The separation of the pivoting rollers 65 from the standby tray rollers 66 may be performed in the second conveying path for discharging the sheet P from the standby tray 10 to the paper discharge tray 16. In the second conveying path, the separation of the pivoting rollers 65 from the standby tray rollers 66 is performed for each one sheet P conveyed to the standby tray 10.

With the sheet processing apparatus and the sheet conveying method explained above, it is possible to form corrugation on the sheet P and suppress the leading end of the sheet P from hanging down.

Second Embodiment

In a sheet processing apparatus according to a second embodiment, the sheet P is struck with the striking member 62 after separating the pivoting rollers 65 of the standby tray 10 from the standby tray rollers 66 for a fixed time during conveyance of the sheet P to the standby tray 10. Components same as those in the first embodiment are denoted by the same reference numerals and signs.

Figure 9:
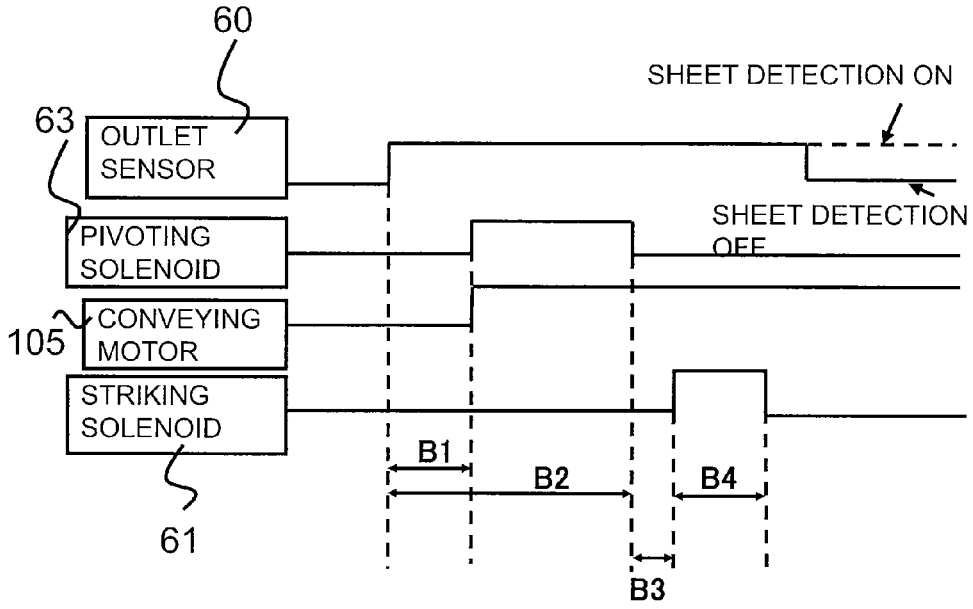
FIG. 9 is a timing chart of pivoting of pivoting rollers and sheet striking by a striking member in a second embodiment.

FIG. 9 is a timing chart of pivoting of the pivoting rollers 65 and striking by the striking member 62. The control section 100 turns on the pivoting solenoid 63 and drives the conveying motor 105 when the number of steps B1 elapses after the outlet sensor 60 detects the sheet P. The control section 100 turns off the pivoting solenoid 63 when the number of steps B2 elapses after the outlet sensor 60 detects the sheet P. The control section 100 turns on the striking solenoid 61 when the number of steps B3 elapses after the control section 100 turns off the pivoting solenoid 63. The control section 100 turns off the striking solenoid 61 when the number of steps B4 elapses after the striking solenoid 61 is turned on. The control section 100 strikes the sheet P with the striking solenoid 61 after the pivoting solenoid 63 is turned off and sheet detection by the outlet sensor 60 is turned off.

The control section 100 strikes the sheet P with the striking member 62 to thereby further form corrugation on the sheet P.

In the above explanation, the striking member 62 strikes the sheet P conveyed to the standby tray 10 in order to form corrugation on the sheet P and strikes the sheet P in order to drop and supply the sheet P from the standby tray 10 to the processing tray 12. However, this is not a limitation. The striking member 62 that strikes the sheet P conveyed to the standby tray 10 in order to form corrugation on the sheet P and a striking member that strikes the sheet P in order to drop and supply the sheet P from the standby tray 10 to the processing tray 12 may be separate members. Concerning a direction of striking of the sheet P, the striking of the sheet P is not limited to striking of the sheet P from above. The sheet P may be struck from below.

With the sheet processing apparatus and the sheet conveying method according to the second embodiment explained above, it is possible to form corrugation on the sheet P and suppress the leading end of the sheet P from hanging down. Further, the pivoting rollers 65 are separated from the standby tray rollers 66 for the fixed time and the sheet P is struck by the striking member 62. Therefore, it is possible to obtain a further effect of suppressing the leading end of the sheet P from hanging down.

Third Embodiment

In a sheet processing apparatus according to a third embodiment, corrugation is continuously formed on the sheet P with the striking member 62 until the sheet P is discharged after the pivoting rollers 65 of the standby tray 10 are separated from the standby tray rollers 66 for a fixed time during conveyance of the sheet P to the standby tray 10. Components same as those in the first embodiment are denoted by the same reference numerals and signs.

Figure 10:
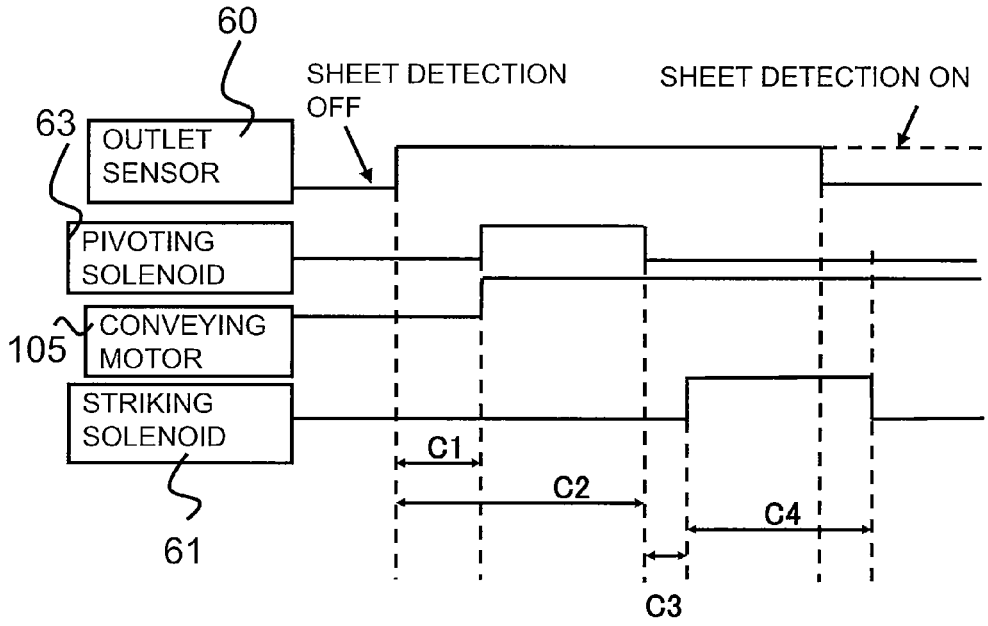
FIG. 10 is a timing chart of pivoting of pivoting rollers and sheet striking by a striking member in a third embodiment.

FIG. 10 is a timing chart of pivoting of the pivoting rollers 65 and striking by the striking member 62. The control section 100 turns on the pivoting solenoid 63 and drives the conveying motor 105 when the number of steps C1 elapses after the outlet sensor 60 detects the sheet P. The control section 100 turns off the pivoting solenoid 63 when the number of steps C2 elapses after the outlet sensor 60 detects the sheet P. The control section 100 turns on the striking solenoid 61 when the number of steps C3 elapses after the control section 100 turns off the pivoting solenoid 63. The control section 100 turns off the striking solenoid 61 when the number of steps C4 elapses after the control section 100 turns on the striking solenoid 61. The control section 100 changes the striking solenoid 61 from ON to OFF when a fixed time elapses after the sheet detection by the outlet sensor 60 is turned off.

While the striking solenoid 61 is kept on, the control section 100 presses the sheet P from above with the striking member 62 until the sheet P is discharged and continues to form corrugation on the sheet P. This is not a limitation. The control section 100 may continue to strike the sheet P plural times until the sheet detection by the outlet sensor 60 is turned off and the fixed time elapses after the pivoting solenoid 63 is turned off.

With the sheet processing apparatus and the sheet conveying method according to the third embodiment explained above, it is possible to form corrugation on the sheet P and suppress the leading end of the sheet P from hanging down. Further, the pivoting rollers 65 are separated from the standby tray rollers 66 for the fixed time and the sheet P continues to be struck by the striking member 62 until the sheet P is conveyed to the standby tray 10. Therefore, it is possible to obtain a further effect of suppressing the leading end of the sheet P from hanging down.

Fourth Embodiment

In a sheet processing apparatus according to a fourth embodiment, the sheet P is struck with the striking member 62 while the pivoting rollers 65 of the standby tray 10 are separated from the standby tray rollers 66 during conveyance of the sheet P to the standby tray 10. Components same as those in the first embodiment are denoted by the same reference numerals and signs.

Figure 11:
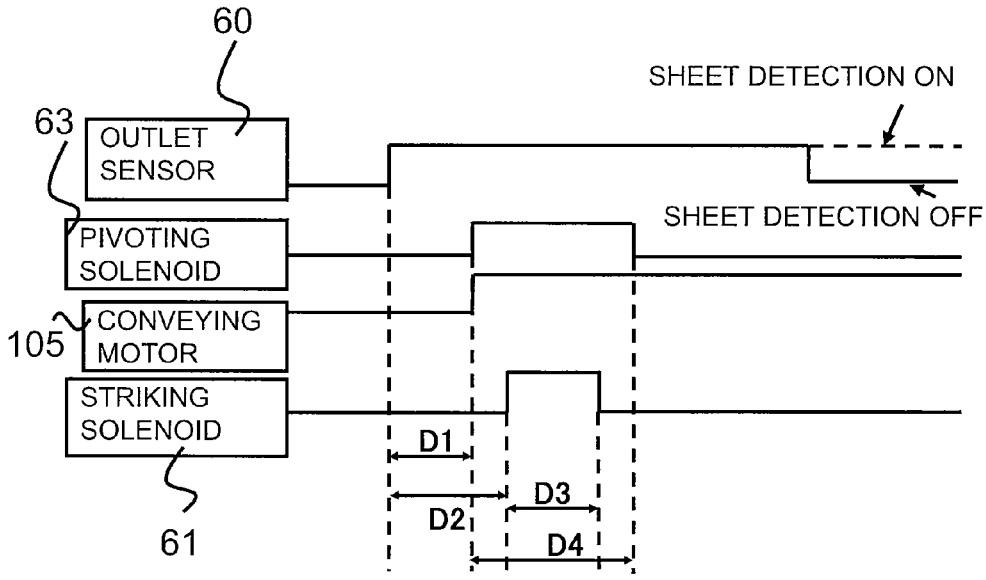
FIG. 11 is a timing chart of pivoting of pivoting rollers and sheet striking by a striking member in a fourth embodiment.

FIG. 11 is a timing chart of pivoting of the pivoting rollers 65 and striking by the striking member 62. The control section 100 turns on the pivoting solenoid 63 and drives the conveying motor 105 when the number of steps D1 elapses after the outlet sensor 60 detects the sheet P. The control section 100 turns on the striking solenoid 61 when the number of steps D2 elapses after the outlet sensor 60 detects the sheet P. The control section 100 turns off the striking solenoid 61 when the number of steps D3 elapses after the striking solenoid 61 is turned on. The control section 100 turns off the pivoting solenoid 63 when the number of steps D4 elapses after the pivoting solenoid 63 is turned on. The number of steps D4 is larger than the number of steps D3. The control section 100 switches the striking solenoid 61 from OFF to ON and from ON to OFF while the pivoting solenoid 63 is on.

The control section 100 controls the striking member 62 to strike the sheet P while the pivoting rollers 65 of the standby tray 10 are separated from the standby tray rollers 66 for a fixed time. When the pivoting rollers 65 are separated from the standby tray rollers 66 for the fixed time, a degree of freedom of the movement of the sheet P increases. Since the sheet P is struck by the striking member 62 in a state in which the degree of freedom of the sheet P is high in this way, corrugation is more easily formed on the sheet P.

The control for striking the sheet P with the striking member 62 while the pivoting rollers 65 are separated from the standby tray rollers 66 for the fixed time is effective when the unsturdy sheet P and the thin sheet P are processed. The control section 100 receives various kinds of information such as a type of the sheet P, a printing mode, and a sheet size transmitted from the image forming apparatus 5. When the control section 100 determines that the type of the sheet is, for example, thin paper according to the various kinds of information transmitted from the image forming apparatus 5, the control section 100 controls the pivoting rollers 65 to separate from the standby tray rollers 66. In this case, the control in 301 in FIG. 8 in the first embodiment is read as "the control section 100 determines whether the sheet P is thin paper from the various kinds of information received by the control section 100". The control section 100 strikes the sheet P with the striking member 62 between 302 and 303 in FIG. 8.

The control for striking the sheet P with the striking member 62 while the pivoting rollers 65 are separated from the standby tray rollers 66 for the fixed time is also effective when the sheet P having a high printing ratio is processed. For example, the sheet P on which a photograph is printed and the sheet P on which solid printing is performed tend to be unsturdy and hang down. The various kinds of information transmitted from the image forming apparatus 5 include a printing ratio as well. When the control section 100 determines that the printing ratio is equal to or larger than a threshold, the control section 100 controls the striking member 62 to strike the sheet P while the pivoting rollers 65 are separated from the standby tray rollers 66 for the fixed time. In this case, the control in 301 in FIG. 8 in the first embodiment is read as "the control section 100 determines whether a printing ratio of the sheet P is equal to or larger than the threshold from the various kinds of information received by the control section 100". The control section 100 strikes the sheet P with the striking member 62 between 302 and 303 in FIG. 8. The threshold is set to, for example, 7% for one sheet.

Alternatively, the control section 100 may determine whether the sheet P is the long-size sheet P, whether the sheet P is thin paper, and whether the printing ratio of the sheet P is equal to or larger than the threshold and, if a result of at least one of the determinations is affirmative, controls the pivoting rollers 65 to separate from the standby tray rollers 66.

If the control section 100 performs the sheet striking with the striking members 62 while the pivoting rollers 65 are separated from the standby tray rollers 66, it is likely that corrugation is excessively formed on the sheet P. Therefore, the control section 100 may perform the sheet striking with the striking member 62 in a state in which the contact state of the pivoting rollers 65 and the standby tray rollers 66 is maintained and nip pressure is reduced rather than separating the pivoting rollers 65 from the standby tray rollers 66.

With the sheet processing apparatus and the sheet conveying method according to the fourth embodiment explained above, it is possible to form corrugation on the sheet P and suppress the leading end of the sheet P from hanging down. Further, the sheet P is struck by the striking member 62 while the pivoting rollers 65 are separated from the standby tray rollers 66 for the fixed time. Therefore, it is possible to obtain a further effect of suppressing the leading end of the sheet P from hanging down.

Fifth Embodiment

In a sheet processing apparatus according to a fifth embodiment, on a side where the pivoting rollers 65 come into contact with the standby tray rollers 66, a rib 73 (a projecting section) is integrally formed in bearing sections 67 that support the pivoting roller shaft 65*a* that rotatably supports the pivoting rollers 65. The sheet processing apparatus forms corrugation on the sheet P with the rib 73. Components same as those in the first embodiment are denoted by the same reference numerals and signs.

Figure 12:
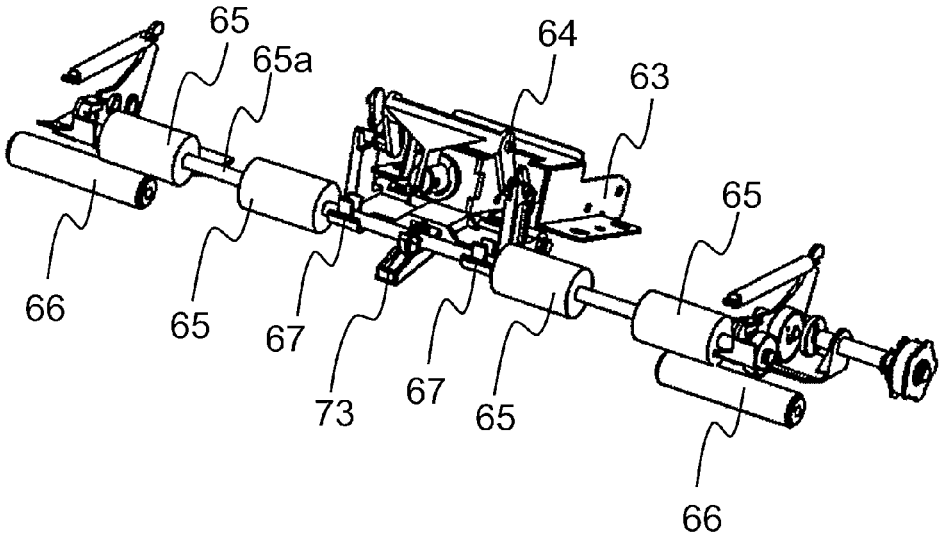
FIG. 12 is a perspective view of pivoting rollers and standby tray rollers in a fifth embodiment.
Figure 13:
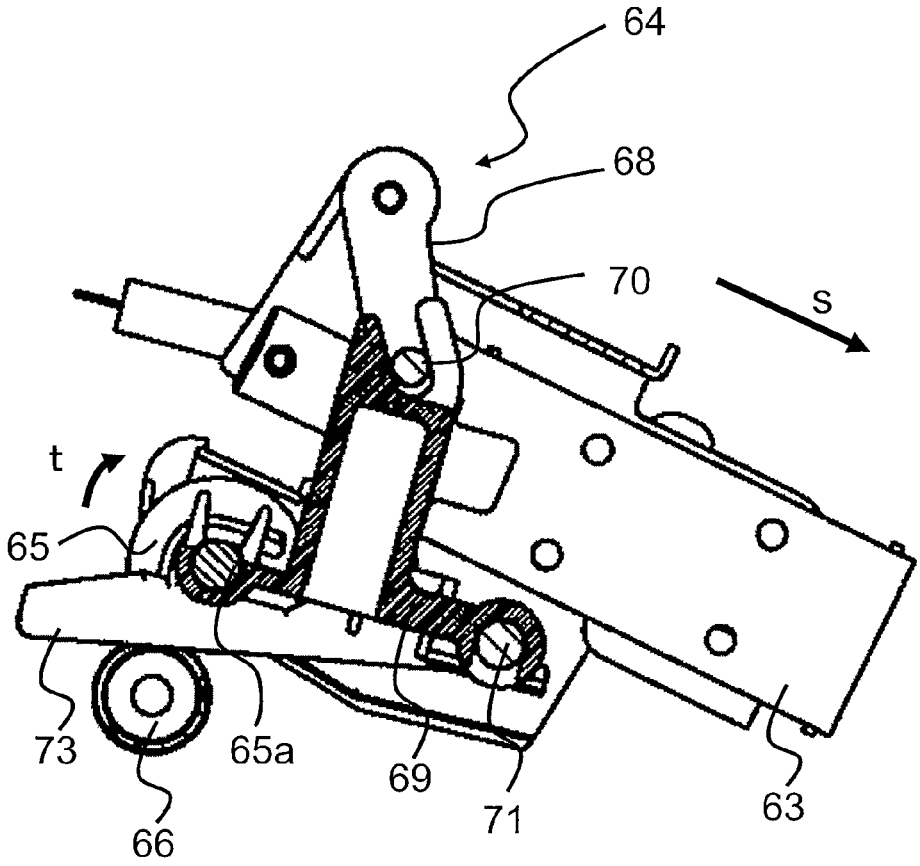
FIG. 13 is a diagram of a contact state of the pivoting rollers and the standby tray rollers in a fifth embodiment.
Figure 14:
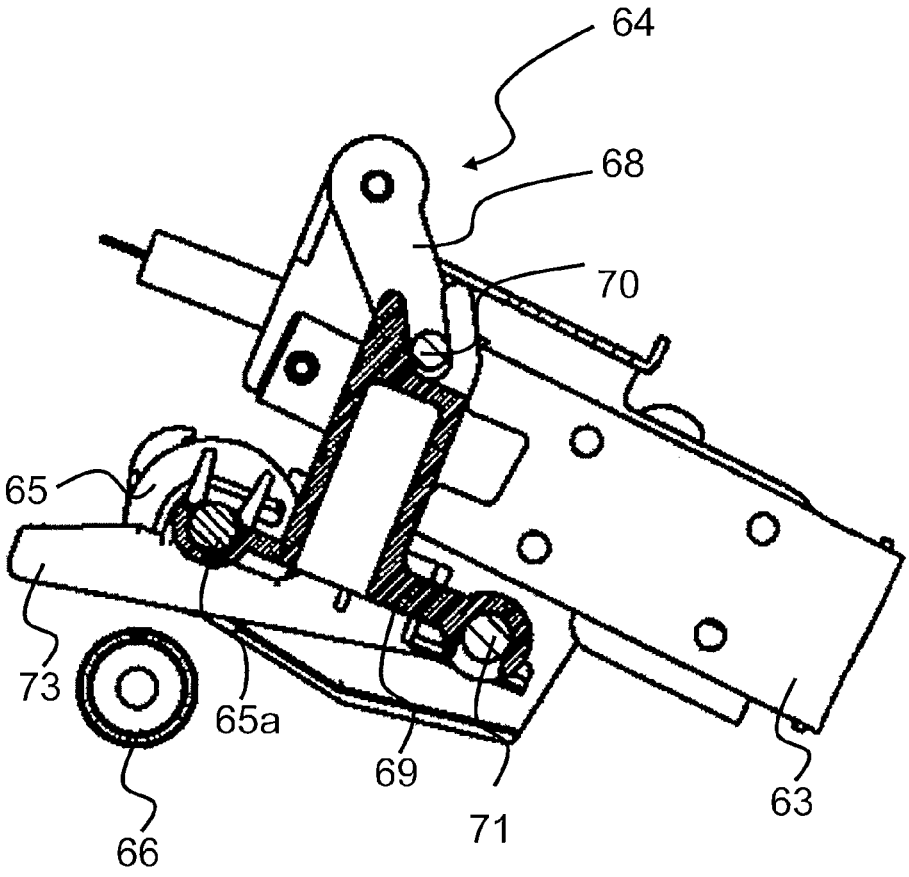
FIG. 14 is a diagram of a separated state of the pivoting rollers and the standby tray rollers in a fifth embodiment.

FIG. 12 is a perspective view of the pivoting rollers 65 and the standby tray rollers 66. FIG. 13 is a diagram of a contact state of the pivoting rollers 65 and the standby tray rollers 66. FIG. 14 is a diagram of a separated state of the pivoting rollers 65 and the standby tray rollers 66.

The contact state of the pivoting rollers 65 and the standby tray rollers 66 is a home position. The arm 64 includes the first arm 68, the second arm 69, the first shaft 70, the second shaft 71, and the pivoting roller shaft 65*a*. The first arm 68 is connected to the pivoting solenoid 63. The second arm 69 is pivotably connected to the first arm 68 via the first shaft 70. The second shaft 71 is fixed. The second arm 69 pivots about the fixed second shaft 71. The pivoting roller shaft 65*a* is connected to the second arm 69.

The rib 73 is connected to the pivoting roller shaft 65*a* via the bearing sections 67 of the pivoting roller shaft 65*a*. As shown in FIG. 12, the rib 73 is desirably located substantially in the center when the pivoting roller shaft 65*a* is viewed from a direction orthogonal to the conveying direction. In other words, the rib 73 is arranged such that corrugation is formed substantially in the center in the width direction of the sheet P.

The rib 73 is shaped to form corrugation on the sheet P in the contact state of the pivoting rollers 65 and the standby tray rollers 66. For example, the distal end of the rib 73 is shaped to project further downward than the position of nips formed when the pivoting rollers 65 and the standby tray rollers 66 come into contact with each other. Since the rib 73 is shaped in this way, the center of the sheet P conveyed to the standby tray 10 is pressed downward by the rib 73 and corrugation is formed.

When the rib 73 comes into contact with the sheet P and forms corrugation on the sheet P, for example, if the sheet P is thin, it is likely that a striking mark remains on the sheet P. Therefore, a protective member may be attached to the lower surface of the rib 73. The protective member is, for example, a sheet or a sponge. The rib 73 may be rounded off at the corners and formed in a roundish shape.

When the pivoting solenoid 63 is turned on, the pivoting solenoid 63 moves in the arrow s direction together with the first arm 68. The second shaft 71 is a fixed shaft. The second arm 69 pivots in the arrow t direction about the fixed second shaft 71. At this point, the pivoting roller shaft 65*a* connected to the second arm 69 also pivots in the arrow t direction together with the second arm 69. Therefore, when the pivoting solenoid 63 is turned on, the pivoting rollers 65 separate from the standby tray rollers 66 (see FIG. 14). At this point, the rib 73 connected to the pivoting roller shaft 65*a* via the bearing sections 67 also pivots in the arrow t direction. When the pivoting solenoid 63 is turned on, the control section 100 drives the pivoting solenoid 63 to locate the rib 73 in a position where the rib 73 does not come into contact with the conveyed sheet P. Alternatively, the rib 73 is shaped not to come into contact with the conveyed sheet P when the pivoting solenoid 63 is turned on.

When the pivoting solenoid 63 is turned off, the pivoting solenoid 63 moves in the direction opposite to the arrow s direction together with the first arm 68 connected to the pivoting solenoid 63. The second arm 69 pivots in the direction opposite to the arrow t direction about the fixed second shaft 71. The pivoting roller shaft 65*a* connected to the second arm 69 also pivots in the direction opposite to the arrow s direction together with the second arm 69. At this point, the rib 73 connected to the pivoting roller shaft 65*a* also pivots in the direction opposite to the arrow t direction. Therefore, when the pivoting solenoid 63 is turned off, the pivoting rollers 65 come into contact with the standby tray rollers 66. The rib 73 returns to a state shown in FIG. 13 together with the pivoting rollers 65.

Figure 15:
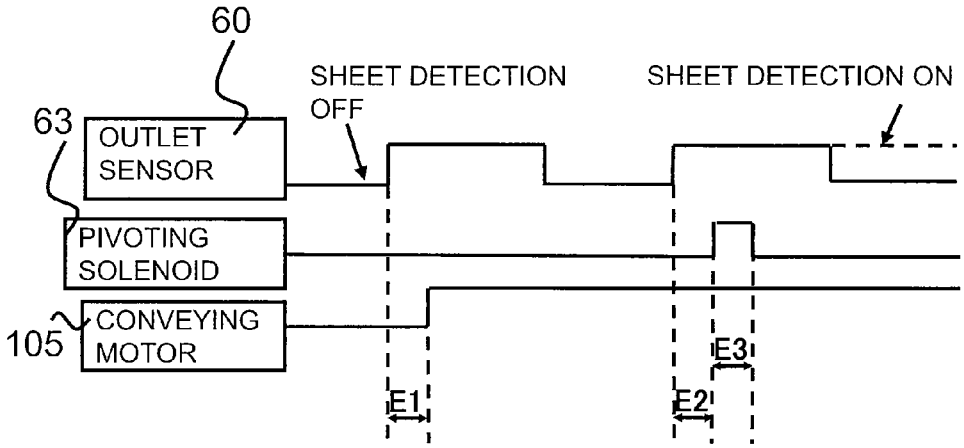
FIG. 15 is a timing chart of pivoting of the pivoting rollers and sheet striking by a striking member in the fifth embodiment.

FIG. 15 is a timing chart of pivoting of the pivoting rollers 65. The timing chart is a timing chart inputting the sheet P on standby on the standby tray 10. In the following explanation with reference to FIG. 15, two sheets P are put on standby on the standby tray 10.

The control section 100 drives the conveying motor 105 when the number of steps E1 elapses after the outlet sensor 60 detects the first sheet P. During the conveyance of the first sheet P to the standby tray 10, the pivoting solenoid 63 is in an OFF state. In other words, the control section 100 performs control to convey the first sheet P in a state in which the rib 73 continues to be in contact with the first sheet P.

Subsequently, the control section 100 turns on the pivoting solenoid 63 when the number of steps E2 elapses after the outlet sensor 60 detects the second sheet P. The control section 100 turns off the pivoting solenoid 63 when the number of steps E3 elapses after the pivoting solenoid 63 is turned on.

During the conveyance of the second sheet P, the first sheet P is stacked on the standby tray 10 in a state in which the first sheet P is held in the nips formed by the pivoting rollers 65 and the standby tray rollers 66. When the second sheet P is conveyed to the roller pairs of the pivoting rollers 65 and the standby tray rollers 66, which already nip the first sheet P, it is likely that a space in which the second sheet P is conveyed is insufficient. In other words, it is likely that the leading end of the second sheet P causes a jam in the roller pairs of the pivoting rollers 65 and the standby tray rollers 66 or in the rib 73. Therefore, timing for turning on the pivoting solenoid 63 after the outlet sensor 60 detects the second sheet P is desirably timing before the leading end of the second sheet P passes on the standby tray rollers 66. The control section 100 sets timing for changing the pivoting solenoid 63 from ON to OFF during the conveyance of the second sheet P to timing after the leading end of the second sheet P passes on the standby tray rollers 66.

The control explained above is not a limitation. The control section 100 may control the pivoting solenoid 63 to be turned on at an early stage after the leading end of the second sheet P passes the roller pairs of the pivoting rollers 65 and the standby tray rollers 66 after the outlet sensor 60 detects the second sheet P. If the pivoting solenoid 63 is turned on at an early stage (e.g., 10 mm after passing the roller pairs) after the leading end of the second sheet P passes the roller pairs of the pivoting rollers 65 and the standby tray rollers 66, it is possible to convey the second sheet P without causing a jam. In the above explanation, the two sheets P are put on standby on the standby tray 10. However, the number of sheets is not limited to two. The control section 100 performs the same control during the conveyance of the second and subsequent sheets P to the standby tray 10.

Even if plural sheets P are put on standby on the standby tray 10, it is possible to sufficiently secure a conveyance space for the second and subsequent sheets P. As in the other embodiments, it is possible to form corrugation on the plural sheets P.

With the sheet processing apparatus and the sheet conveying method according to the fifth embodiment explained above, it is possible to form corrugation on the sheet P and suppress the leading end of the sheet P from hanging down. Further, since corrugation is formed by the rib 73, it is possible to obtain a further effect of suppressing the leading end of the sheet P from hanging down. Even if the plural sheets P are put on standby on the standby tray 10, it is possible to sufficiently secure a conveyance space for the second and subsequent sheets P. Further, as in the other embodiments, it is possible to form corrugation on the plural sheets P.

Sixth Embodiment

In a sheet processing apparatus according to a sixth embodiment, the pivoting rollers 65 of the standby tray 10 is separated from the standby tray rollers 66 for a fixed time and corrugation is formed on the sheet P with the rib 73 connected to the pivoting roller shaft 65*a*, which rotatably supports the pivoting rollers 65, via the bearing sections 67 of the pivoting roller shaft 65*a*. Components same as those in the first embodiment are denoted by the same reference numerals and signs.

Figure 16:
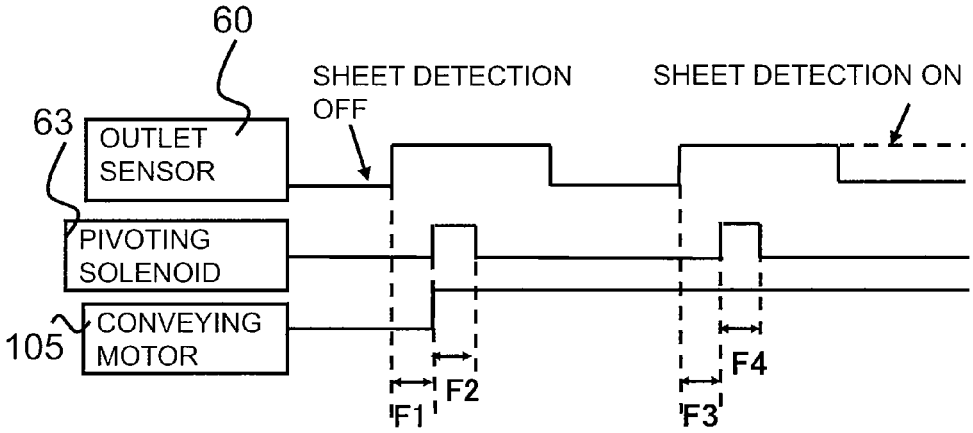
FIG. 16 is a timing chart of pivoting of pivoting rollers and sheet striking by a striking member in a sixth embodiment.

FIG. 16 is a timing chart of pivoting or the pivoting rollers 65. The timing chart is a timing chart in putting plural sheets P on standby on the standby tray 10. In the explanation with reference to FIG. 16, two sheets P are put on standby on the standby tray 10.

The control section 100 turns on the pivoting solenoid 63 and drives the conveying motor 105 when the number of steps F1 elapses after the outlet sensor 60 detects the first sheet P. The control section 100 turns off the pivoting solenoid 63 when the number of steps F2 elapses after the pivoting solenoid 63 is turned on.

Subsequently, the control section 100 turns on the pivoting solenoid 63 when the number of steps F3 elapses after the outlet sensor 60 detects the second sheet P. The control section 100 turns off the pivoting solenoid 63 when the number of steps F4 elapses after the pivoting solenoid 63 is turned on.

Timing for turning on the pivoting solenoid 63 after the outlet sensor 60 detects the first sheet P is timing before the leading end of the first sheet P passes on the standby tray rollers 66 or at an early stage after the leading end of the first sheet P passes the roller pairs of the pivoting rollers 65 and the standby tray rollers 66. If the plural sheets P are put on standby on the standby tray 10, timing for turning on the pivoting solenoid 63 after the outlet sensor 60 detects the second and subsequent sheets P is timing before the leading end of the second sheet P passes on the standby tray rollers 66 or at an early stage after the leading end of the second sheet P passes the roller pairs of the pivoting rollers 65 and the standby tray rollers 66.

With the sheet processing apparatus and the sheet conveying method according to the sixth embodiment explained above, it is possible to form corrugation on the sheet P and suppress the leading end of the sheet P from hanging down. Further, since the pivoting rollers 65 of the standby tray 10 is separated from the standby tray rollers 66 for the fixed time and corrugation is formed by the rib 73, it is possible to obtain a further effect of suppressing the leading end of the sheet P from hanging down. Even if the plural sheets P are put on standby on the standby tray 10, it is possible to sufficiently secure a conveyance space for the second and subsequent sheets P.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a paper feeding section configured to receive and feed a sheet conveyed from an apparatus having a control panel;

a detecting section configured to detect the sheet fed by the paper feeding section;

a standby tray on which the sheet fed by the paper feeding section is stacked, the standby tray including a first roller configured to convey the sheet;

a second roller located above the standby tray and configured to come into contact with and separate from the first roller;

a processing tray on which the sheet supplied from the standby tray is stacked, the processing tray configured to hold the sheet while a selected processing is applied to the sheet;

a paper discharge section configured to receive the sheet subjected to the processing and discharged from the processing tray; and a control section configured to separate the second roller from the first roller at a predetermined time according to a result of the detection by the detecting section during conveyance of the sheet to the standby tray; wherein the control section receives information set on the control panel and determines, according to the received information, whether separating the second roller from the first roller is to be performed.

2. The apparatus according to claim 1, wherein the predetermined time is before a leading end of the sheet passes the first roller and the second roller.

3. The apparatus according to claim 1, wherein the predetermined time is after a leading end of the sheet passes the first roller and the second roller.

4. The apparatus according to claim 1, wherein, if the control section determines, according to the received information, that the sheet is a long-size sheet, the control section determines that separating the second roller from the first roller is to be performed.

5. The apparatus according to claim 1, wherein, if the control section determines, according to the received information, that the sheet is thin paper, the control section determines that separating the second roller from the first roller is to be performed.

6. The apparatus according to claim 1, further comprising a striking member configured to strike a sheet surface of the sheet stacked on the standby tray, wherein the control section controls, on the basis of a sheet detection by the detecting section, the striking member to strike the sheet when the sheet is present on the standby tray.

7. The apparatus according to claim 6, wherein the control section controls the striking member to strike the sheet after the second roller is separated from the first roller.

8. The apparatus according to claim 7, wherein the control section controls the striking member to strike the sheet until conveyance of the sheet to the standby tray ends.

9. The apparatus according to claim 6, wherein the control section controls the striking member to strike the sheet while the second roller is being separated from the first roller.

10. The apparatus according to claim 6, wherein the control section receives information set on the control panel and determines, according to the received information, whether striking the sheet with the striking member is to be performed.

11. The apparatus according to claim 1, further comprising a projecting section connected to a bearing section of a rotating shaft of the second roller and configured to come into contact with the sheet and curve the sheet when the first roller and the second roller are in contact with each other.

12. The apparatus according to claim 11, wherein, if the sheet conveyed to the standby tray is the first sheet, the control section brings the projecting section into contact with the sheet until the conveyance to the standby tray ends after a leading end of the sheet comes into contact with the projecting section.

13. The apparatus according to claim 12, wherein, if a plurality of the sheets are put on standby on the standby tray, when the second and subsequent sheets are conveyed, the control section separates the second roller from the first roller before the leading end of the sheet comes into contact with the projecting section.

14. The apparatus according to claim 11, wherein the control section separates the second roller from the first roller before a leading end of the sheet passes a roller pair of the first roller and the second roller and brings the second roller into contact with the first roller after the leading end of the sheet passes the first roller.

15. A sheet conveying method comprising:

detecting a sheet conveyed from an apparatus;

receiving information set on a control panel on the apparatus;

stacking the sheet on a standby tray including a first roller configured to convey the sheet;

supplying the sheet from the standby tray and stacking the sheet on a processing tray;

applying processing to the sheet while the sheet is stacked on the processing tray; and based on the information set on the control panel, moving a second roller from a first position in contact with the first roller to a second position not in contact with the first roller at predetermined time according to a result of the detection of the sheet.

16. The method according to claim 15, further comprising striking, on the basis of the result of the detection of the sheet, the sheet with a striking member when the sheet is present on the standby tray.

17. The method according to claim 15, further comprising curving, when the first roller and the second roller are in contact with each other, the sheet with a projecting section connected to a bearing section of a rotating shaft of the second roller.

18. The method according to claim 15, further comprising moving the second roller to the second position based on the information set on the control panel indicating that the sheet is a long-size sheet.

* * * * *